US008302441B2

(12) United States Patent
Slavenburg

(10) Patent No.: US 8,302,441 B2
(45) Date of Patent: Nov. 6, 2012

(54) STRAIGHTENING DEVICE

(75) Inventor: Johannes Cornelis Slavenburg, Made (NL)

(73) Assignee: Reparatie Onderhoud Slavenburg, AC Made (NL)

( * ) Notice: Subject to any disclaimer, the term of this patent is extended or adjusted under 35 U.S.C. 154(b) by 556 days.

(21) Appl. No.: 11/794,704

(22) PCT Filed: Jan. 4, 2006

(86) PCT No.: PCT/NL2006/000002

§ 371 (c)(1),
(2), (4) Date: Sep. 2, 2008

(87) PCT Pub. No.: WO2006/073304

PCT Pub. Date: Jul. 13, 2006

(65) Prior Publication Data

US 2009/0078019 A1 Mar. 26, 2009

(30) Foreign Application Priority Data

Jan. 5, 2005 (NL) ..... 1027957

(51) Int. Cl.
*B21C 51/00* (2006.01)

(52) U.S. Cl. ..... 72/31.02; 72/31.03; 72/457; 72/705

(58) Field of Classification Search ..... 72/31.02, 72/31.03, 389.1, 457, 705, 392, 393, 452.1, 72/381, 399, 400, 383, 316, 293, 295, 296; 254/43, 104, 108

See application file for complete search history.

(56) References Cited

U.S. PATENT DOCUMENTS

| | | | | |
|---|---|---|---|---|
| 2,461,839 | A * | 2/1949 | Neutelings | 72/208 |
| 3,673,842 | A * | 7/1972 | Sanchez | 72/293 |
| 3,986,383 | A * | 10/1976 | Petteys | 72/393 |
| 4,400,968 | A * | 8/1983 | Barbieri | 72/457 |

FOREIGN PATENT DOCUMENTS

| | | |
|---|---|---|
| CA | 2108746 | 4/1995 |

* cited by examiner

*Primary Examiner* — Edward Tolan
*Assistant Examiner* — Matthew G Katcoff
(74) *Attorney, Agent, or Firm* — Meyertons, Hood, Kivlin, Kowert & Goetzel, P.C.; Eric B. Meyertons

(57) ABSTRACT

The present invention relates to a device (6) and method for repairing an upright profile (2) which has been bent out of an original position, in particular a profile of a warehouse rack upright for mounting of warehouse rack girders (3), wherein an inner space (13) accessible from an open side is defined in the profile. The device comprises an outer template (7) adapted to the form of the outer surface of the profile, an inner template (16,17) adapted to the form of the inner surface, wherein during use the inner template is arranged in the inner space of the profile via the open side, and pressing means for pressing the outer template against the outer side of the profile and pressing the inner template against the inner side of the profile with pressing force such that the upright profile is bent back into its original position.

15 Claims, 4 Drawing Sheets

STRAIGHTENING DEVICE

The present invention relates to a device and method for repairing an upright profile which has been bent out of an original position, in particular a profile of a warehouse rack upright for mounting of warehouse rack girders, wherein an inner space accessible from an open side is defined in the profile.

For the storage of loose goods such as electronic components, domestic appliances, furniture and the like, storage warehouses are known in which the goods for storing can be stored temporarily in racks. Such storage areas are usually constructed from a number of storage racks arranged in rows. Each storage rack is constructed from a number of upright profiles, to which a number of girder profiles are fixed. Struts are further placed on the upright profiles (also referred to herein as uprights) at a number of positions in order to ensure the stability of the rack.

Used in many cases for the purpose of arranging goods in the racks or removing them therefrom are mobile mechanical aids such as for instance fork-lift trucks or other means of transport. These make it possible for many goods, irrespective of number and weight, to be placed in or removed from the rack by a single person.

A problem which occurs when such mobile mechanical aids are applied is that these can damage the uprights. When a fork-lift truck is used the situation can for instance occur that this dents the lower part of the upright as a result of a collision therewith. The structural strength of the upright is hereby reduced, which can result in collapse of the rack.

In order to avoid this drawback it is deemed known to replace the damaged upright with a new upright. The rack must hereby be locally emptied and disassembled, whereafter the upright is replaced by a new upright. After the upright has been replaced the rack must be reassembled and refilled. It will be apparent that this is a very time-consuming procedure and entails high costs. Additional equipment such as a boom truck is moreover often necessary to empty the rack and then refill it.

Already known from the Canadian document CA 2 108 746 A1 is a clamping tool with which a bent rail of a sliding door or window can be bent back again. From the document is known a female part adapted to the form of the outer surface of the rail, wherein the female part partially encloses the rail profile during use. A male part adapted to the form of the inner surface of the rail is also known. The male and female parts are further arranged on a clamping tool for the purpose of bending back the rail. The existing clamping tool is however unsuitable for bending back upright profiles, in particular rack uprights, since too little pressure force can be generated using the clamping construction. With the existing clamping tool it is moreover only possible to treat one corner part of the profile at a time, which makes it practically impossible to bend back sufficiently a profile provided with two or more corner parts.

The present invention has for its object to obviate the drawbacks associated with the prior art and to make it possible to repair a damaged upright in rapid and efficient manner without the rack herein having to be emptied.

According to a first aspect of the present invention there is provided a device for repairing an upright profile of the above stated type which has been bent out of an original position, wherein the device comprises:

an outer template adapted to the form of the outer surface of the profile, wherein the outer template partly encloses the profile during use;

an inner template adapted to the form of the inner surface, wherein during use the inner template is arranged in the inner space of the profile via the open side;

pressing means for pressing the outer template against the outer side of the profile and pressing the inner jib against the inner side of the profile with pressing force such that the upright profile is bent back into its original position, wherein the inner template comprises a first template part and a second template part, wherein the first and second template parts each have an external form which is adapted to a corresponding part of the inner space of the profile, and wherein the pressing means are adapted to press the first and second template parts against the profile through mutual displacement of the template parts.

By bending the damaged upright back substantially to its original form using this device, the structural strength of the construction is restored, or at least considerably improved, without it being necessary here to reduce the load on the upright by emptying and disassembling the rack. Two or more corner parts of the profile can moreover be bent back simultaneously.

According to a first preferred embodiment of the invention, an intermediate space in which pressing means can be placed is provided between the template parts when the template parts are placed in the profile, wherein the pressing means are adapted to press the template parts in forward and lateral direction against the profile.

According to a further preferred embodiment, the device comprises:

a yoke which can be coupled to the outer template;

a pressing unit to be arranged on the yoke and resting on the inner template. The yoke can herein be fixed to the outer template, for instance by being screwed to the outer template, but can also be positioned around the outer side of the outer template. The pressing unit can herein comprise an electrical or mechanical pressing unit or, preferably, a hydraulic or pneumatic pressure cylinder.

In a determined embodiment the pressing unit is a manually operated pressure cylinder so that the pressing unit functions independently of an external or internal power supply.

In a further preferred embodiment each of the template parts is provided with a chamfered positioning edge so that the pressing component can be readily placed between the inner template parts.

According to a further preferred embodiment, the width of the outer template is given an adjustable form. In practice uprights often have an identical basic profile design. This is understood to mean that the cross-sectional form of profiles intended for different purposes and/or suitable for different structural loads is in many cases identical. The cross-sectional dimensions can however vary here. In this embodiment the outer template is embodied such that it can be adjusted to the specific cross-sectional dimensions of the profiles for treating. This makes this embodiment of the invention universally suitable for treating numerous different profiles.

According to a further preferred embodiment of the invention, the device comprises a plate-like filling component with a thickness practically corresponding to the clearance between the inner template and a profile in the original state. With such a filling part the damaged upright can be returned with greater precision to its original form.

According to another aspect of the present invention the object is achieved in a method for repairing an upright profile bent out of an original position, in particular a profile of a warehouse rack upright for mounting of warehouse rack girders, wherein an inner space accessible from an open side is defined in the profile, the method comprising of:

arranging round the bent profile an outer template adapted to the form of the outer surface of the profile and partially enclosing the profile;

arranging an inner template adapted to the form of the inner surface of the profile in the inner space of the profile via the open side;

pressing the outer template against the outer side of the profile and pressing the inner template against the inner side of the profile in order to bend the upright profile back to its original position, wherein arranging of the inner template comprises of:

arranging a first template part of the inner template in a part of the inner space of the profile; and arranging a second template part of the inner template in another part of the inner space of the profile;

and wherein pressing of the outer template and inner template against the profile comprises of:

mutually displacing the template parts until the template parts rest against the inner side of the profile;

pressing the outer template against the outer side of the profile and pressing the template parts of the inner template against the inner side of the profile.

The method preferably comprises of:

arranging a first template part of the inner template in a part of the inner space of the profile;

arranging a second template part of the inner template in another part of the inner space of the profile;

placing a wedge-shaped pressing component in the intermediate space between the first and second template part;

pressing the wedge-shaped pressing component further into the intermediate space in order to generate lateral pressure whereby the template parts are pressed against the profile.

The method preferably also comprises of:

placing a yoke round the outer template;

arranging a pressing unit on the yoke;

exerting a pressing force on the wedge-shaped component with the pressing unit in order to press the outer and inner template against the profile.

In order to achieve a greater accuracy in bending back of the upright and/or to be able to arrange the inner template parts more easily in the inner space in the upright, especially when the upright is greatly deformed, the method preferably comprises, after the above stated bending back of the profile, of arranging a plate-like filling part in the intermediate space between the inner template and the profile, and of repeating the step of pressing the outer template against the outer side of the profile and pressing the inner template against the inner side of the profile in order to bend the profile back further.

As stated above, the bending back of the uprights can be applied according to the invention to uprights of for instance a rack that are in use, i.e. to uprights under load. This means that the rack does not have to be emptied, which entails a large saving in costs and working hours. It will be apparent that in some cases, for instance when the damage to the upright is very serious, it will be necessary to nevertheless empty the rack before a start is made with the repair of the upright in the manner described herein.

Further advantages, features and details of the present invention will be elucidated on the basis of the following description of several preferred embodiments thereof. Reference is made in the description to the figures, in which.

Figure 2:
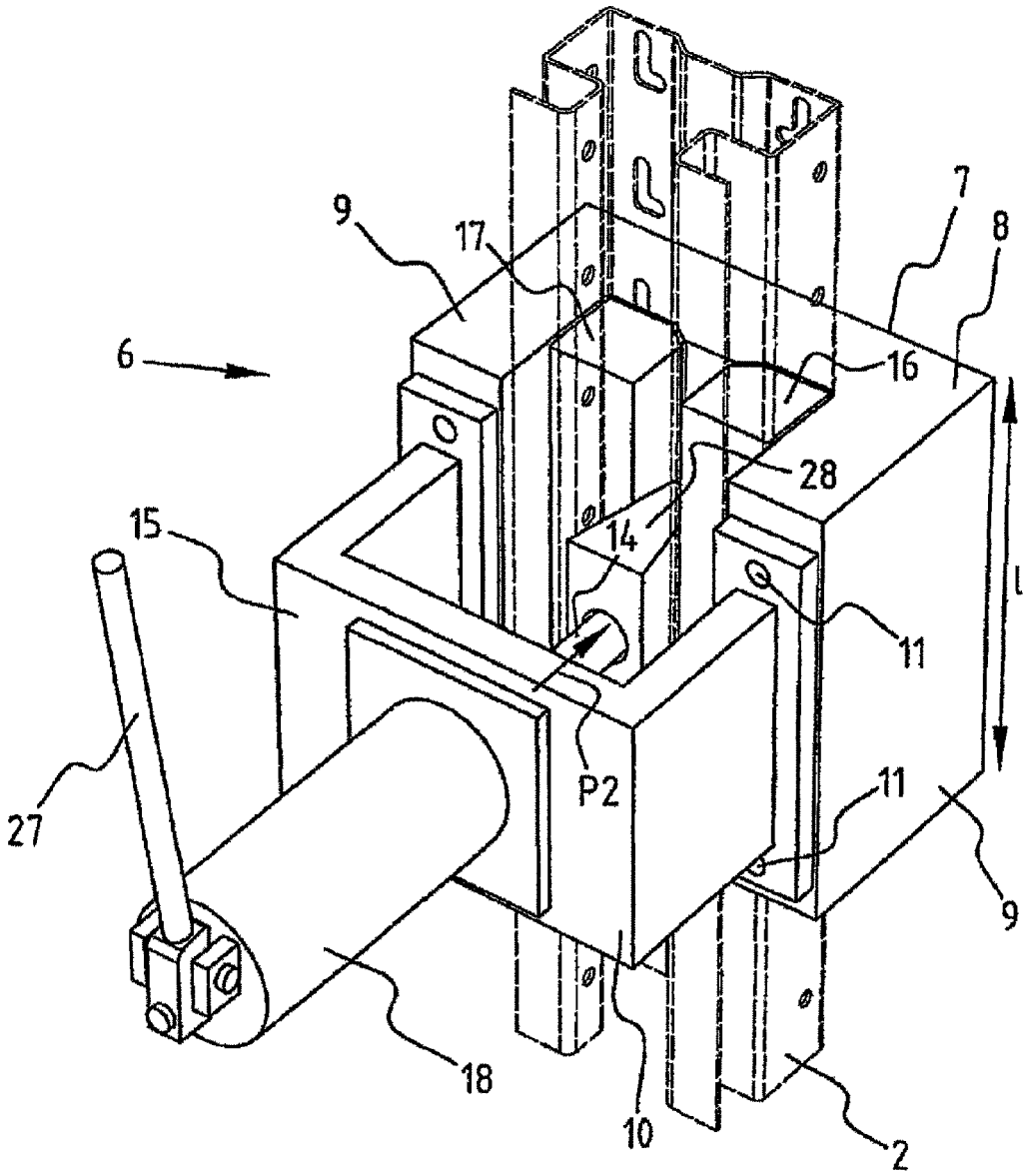
FIG. 2 shows a perspective view of a first preferred embodiment of the invention.
Figure 5:
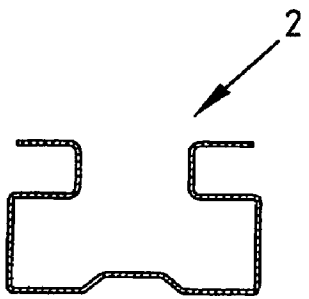
Figure 6:
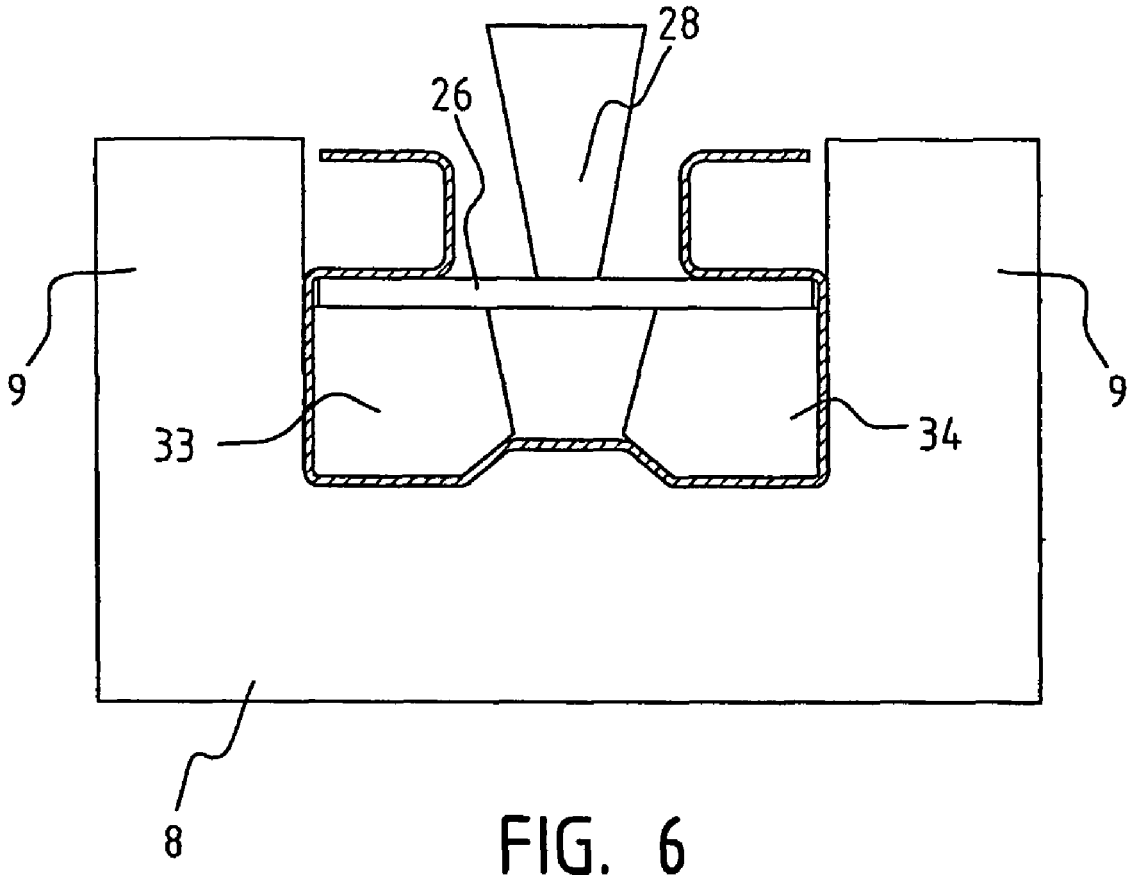
Figure 7:
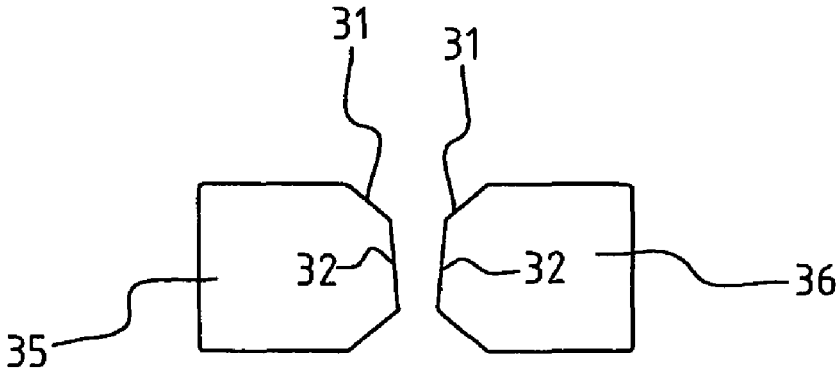

FIGS. 4*a*-4*d* are cross-sections through the preferred embodiment shown in FIG. 2 and through the damaged upright;

FIG. 5 shows a cross-section of a repaired upright;

FIG. 6 shows a cross-section of an upright and a second preferred embodiment of the invention; and FIG. 7 shows a cross-section of inner templates which are provided with a positioning edge.

Figure 1:
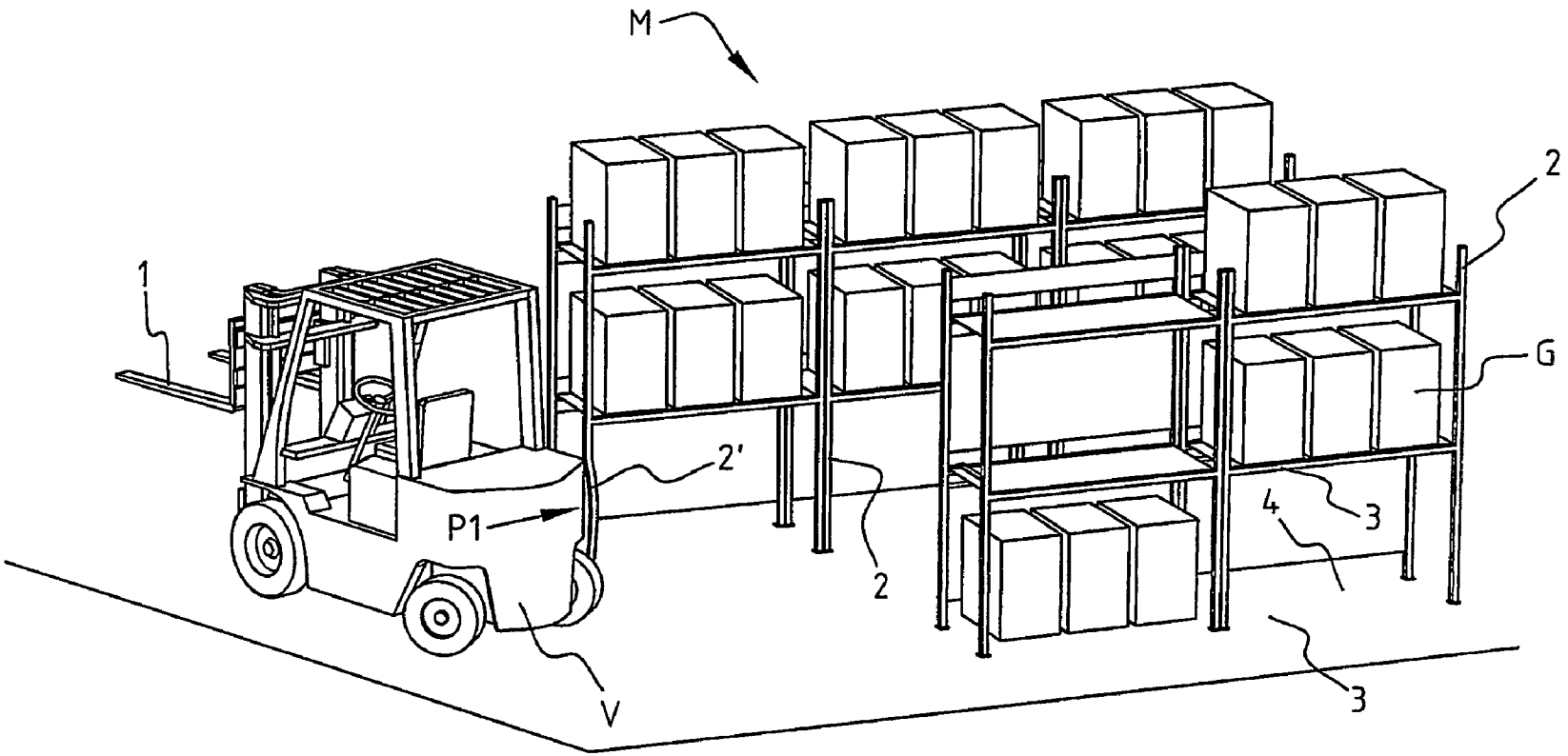
FIG. 1 shows a perspective view of a warehouse rack with a damaged upright.
Figure 3:
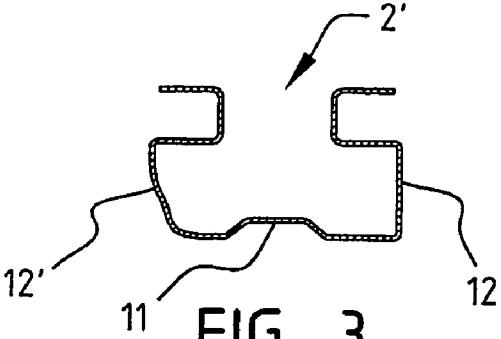
FIG. 3 shows a cross-section of a damaged upright profile.

FIG. 1 shows a warehouse M in which racks are arranged in rows. Each rack consists of a number of upright elements or upright profiles 2 between which girder profiles 3 are mounted in known manner, for instance using hooks or screws. FIG. 3 shows a cross-section of such a profile. A number of corner parts are provided in the profile so that the profiles possess the desired structural properties. An example of such an upright is an upright with a width of 100 mm, a depth of 66 mm and a (steel) plate thickness of 2.2 mm. Between uprights 2 and girder profiles 3 there can further be provided stabilizing arms (not drawn) whereby the stability of the racks can be increased. Arranged between girder profiles 3 are plates 4 on which goods G for storing can be stacked. In the shown embodiment of the racks three levels are provided in each case for storing the goods at three different heights. It will be apparent that the number of levels can vary as desired.

So as to arrange goods in or remove them from the racks, use is made in the embodiment shown here of a mobile fork-lift truck V. Fork-lift truck V is provided in known manner with a height-displaceable fork 1 on which goods can be placed. Using the fork-lift truck an operative can place the goods at any desired height in the rack, or remove the goods therefrom.

When an operative (not shown) is for instance processing an order, he/she must collect different goods from different positions in the warehouse rack. It is possible here for fork-lift truck V to accidentally collide with a rack. This has the result that the rack, and more specifically the lower part of an upright thereof, can be damaged. FIG. 1 shows that fork-lift truck V takes a bend too sharply (arrow $P_1$) and hereby comes into contact with an upright 2'. It will be apparent that countless other situations can be envisaged in which uprights in a rack can be damaged. In all these cases the upright is bent, as a result of which the strength of the upright decreases considerably. Certainly when heavy goods are arranged in the rack, this means that the stability of the rack is seriously reduced.

Tests have for instance shown that as a result of such damage the failure load of an upright, i.e. the load at which a vertical upright collapses, has a value of 40% or more less than that of an undamaged upright.

Figure 4B:
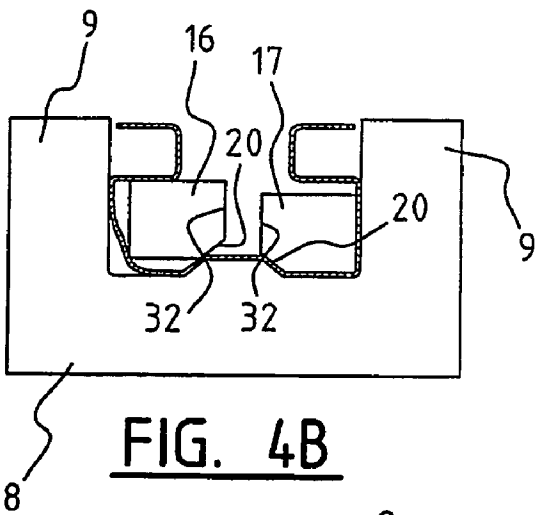
Figure 4A:
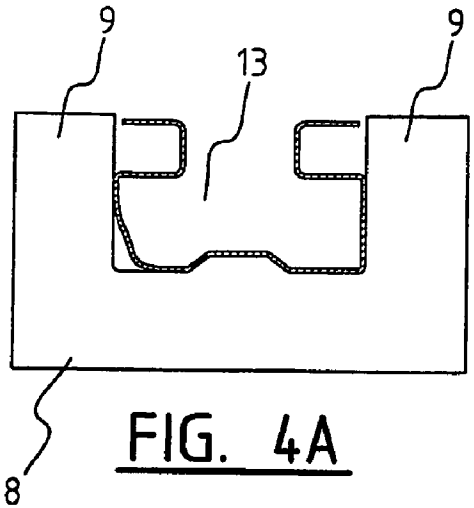

According to the invention the damaged upright 2' can now be repaired without the rack here having to be emptied and disassembled. For this purpose an outer template 7 of a device 6 according to a first preferred embodiment of the invention is placed around the rear side of upright 2', as shown in FIGS. 2 and 4*a*. Outer template 7 consists of a body 8 with parts 9 protruding on either side. The form and dimensions of the inner surface of the body and the protruding parts are adapted to those of the outer surface of the rear side 11 (FIG. 3) and to sides 12 (at least the form and dimensions as they were originally) of the upright, i.e. the form and dimensions of the relevant corner part of the profile, as for instance shown in FIG. 4*a*. Although in FIG. 2 the length l and the width of the outer template are roughly the same, in most cases length l is in practice much greater than the width. In standard profiles with a width of about 10 cm the outer template then has a length l of a minimum of 0.5 m, preferably 1.0 m or more.

Once outer template 7 has been arranged around the rear side 11 and the undamaged and damaged side walls 12, 12' respectively, a yoke 15 is arranged on the end surfaces of the protruding parts 9 of outer template 7. In the shown embodiment yoke 15 is arranged by being screwed fixedly onto outer template 7 using screws 11. It is however possible to envisage numerous alternative fixing options. Yoke 15 can for instance be placed around outer template 7 so that the outer template can as it were be pressed against the outer side of the upright profile.

Yoke 15 is provided with a hydraulic pressure cylinder 18 in which a piston 14 can be moved. Other drive units, such as electrical or mechanical pressing units, can be applied instead of or in addition to hydraulic cylinder 18. Hydraulic cylinder 18 can be activated using operating element 27 so that the piston 14 displaces the wedge-shaped pressing element 28 provided in the end hereof in the direction of $P_2$ (see for instance FIG. 2).

Depending on the type of deformation and the degree thereof, pressing element 28 is optionally guided into inner space 13 of upright profile 2'. When upright 2' is for instance greatly deformed, pressing element 28 is pressed inward to bend the upright back in a first step. Once the upright has thus been bent back sufficiently and the situation has for instance been created as shown in FIG. 3, in which only the left-hand side 12' of upright 2' is still bent, two elongate inner templates 16, 17 are arranged in inner space 13 of upright 2' as shown in FIG. 4*b*. The length of the inner templates roughly corresponds to that of outer template 7. The form and dimensions of the outer surfaces of inner templates 16, 17 are such that these correspond to those of the relevant parts of the inner surfaces of upright 2'.

Figure 4D:
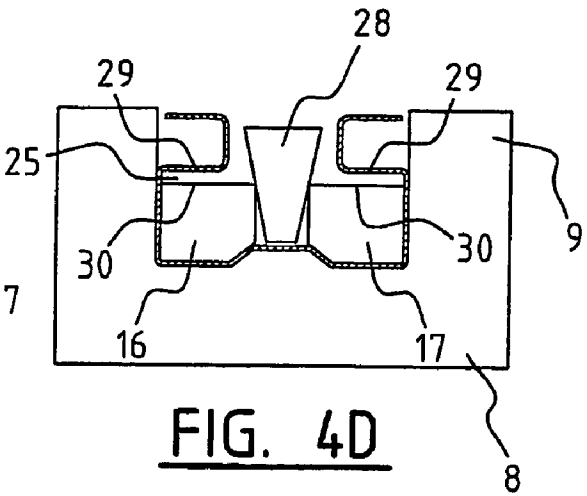

As a result of the wedge shape of pressing element 28, the above stated inner templates 16 and 17 are urged substantially obliquely to the side (direction $P_3$ and $P_4$). In the situation shown in the figures this means that the left-hand inner template 16 bends the bent part 12' of upright 2' back in the direction of the relevant protruding part 9 of outer template 7 until upright 2 regains its original form as a result of the special form of the outer and inner templates, as shown in FIG. 4*d*. When upright 2' has thus (practically) regained its original form, inner templates 16 and 17 and outer template 7 are removed and in this situation (as shown in FIG. 5) the upright has regained a large part of its original structural strength.

Recent tests (in accordance with the Federation Européenne de la manutention (FEM) 10.2.02 standard, "The design of static steel pallet racking", version 1.02, April 2001) have shown that, depending on the degree of damage to the uprights, after the bending back according to the method described herein a structural strength remains which is only slightly (in most cases only a few percent) less than the original strength. It has also been found that in some situations the structural strength of the uprights after being bent back is even higher than the original strength.

Figure 4C:
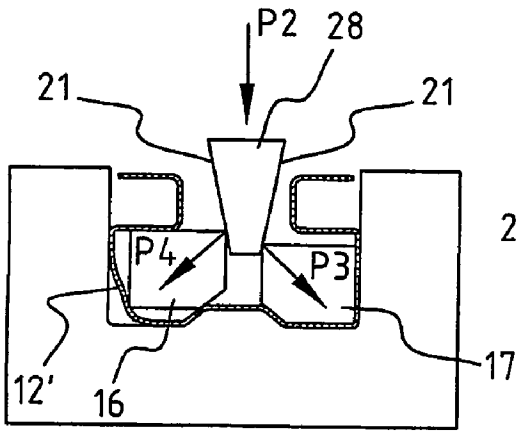

Although in the embodiment shown in FIGS. 4*b*-4*d* inner templates 16 and 17 are provided with straight surfaces on their sides 32 directed toward pressing element 28, in the embodiment of inner templates 33 and 34 shown in FIG. 6 the side surfaces 32 extend at a slight angle. Side surfaces 32 are hereby adapted more to the wedge shape of pressing element 28, so that a better pressing of inner templates 33,34 against upright 2' is often possible in practice.

In order to provide sufficient space for the inner templates 33,34 to be arranged in inner space 13 when an upright 2' is bent, these templates are given a slightly smaller form than the related parts of inner space 13. This means that, when inner templates 33,34 are displaced outward in the above described ways by means of wedge-shaped pressing element 28, there is a small clearance or intermediate space 25 between side 30 of inner templates 33,34 and parts 29 of the upright. Once the situation as shown in FIG. 4*d* has been realized and pressing element 28 is retracted, this intermediate space 25 is preferably partially filled with a plate 26, as shown in FIG. 6. This plate 26 has a thickness practically corresponding to the thickness of intermediate space 25. Once plate 26 has been arranged there is practically no longer any clearance between inner templates 33,34 and the inner surface of upright 2'. When pressing element 28 is now pressed against plate 26 under high pressure, preferably after the pressing element is rotated through 180 degrees so that the relatively wide part thereof rests against plate 26, a further bending back of the bent upright 2' occurs so that the upright is returned even more precisely to its original shape and thereby regains even more of its original strength.

FIG. 7 further shows an embodiment in which inner templates 35,36 have chamfered surfaces 31. The chamfered surfaces function as "positioning edges" with which the pressing element is guided more readily into the space between the inner templates, and an easier handling of device 6 can hereby be brought about.

The invention is not limited to the preferred embodiments thereof described herein. The rights sought are rather defined by the following claims, within the scope of which many modifications can be envisaged. Although in the described preferred embodiments of the invention the inner template is pressed against the inner side of the profile, which has the result that the outer template is also pressed against the outer side of the profile, in other preferred embodiments of the invention the pressing means can be adapted to press the outer template against the outer side of the profile, which has the result that the inner template is also pressed against the inner side of the profile.

The invention claimed is:

1. A device for repairing an upright profile which has been bent out of an original position, wherein an inner space accessible from an open side is defined in the profile, the device comprising:

an outer template having a shape at least substantially complementary to an original form of the outer surface of the profile, wherein the outer template encloses at least a portion the profile during use;

an inner template having a shape at least substantially complementary to an original form of the inner surface of the profile, wherein the inner template is arranged in the inner space of the profile during use; and a press comprising a drive unit and a pressing element, wherein the drive unit is connected to the outer template, and wherein the pressing element is coupled to the inner template such that, during use, the drive unit urges the pressing element against the inner template, the inner template being urged by the pressing element against the inner side of the profile with pressing force such that the upright profile is bent back into its original form, and wherein the force of the pressing element against the inner template urges the drive unit away from the inner template, wherein the movement of the drive unit away from the inner template pulls the outer template against the outer surface of the profile such that the outer surface is bent back into its original form by the outer template;

wherein the inner template comprises a first inner template part and a second inner template part, wherein the first and second inner template parts each have an external shape at least substantially complementary to a corresponding portion of the inner space of the profile, and wherein, during use, the pressing element urges each of the first and second inner template parts against the profile via mutual displacement of the first and second inner template parts away from each other.

2. The device as claimed in claim 1, wherein an intermediate space in which at least a portion of the press can be placed is provided between the first and second inner template parts when the first and second inner template parts are arranged in the inner space of the profile, and wherein, during use, the press urges each of the first and second inner template parts in respective forward and lateral directions against the profile.

3. The device as claimed in claim 1, wherein during use an elongate intermediate space is formed between the first and second inner template parts, and wherein the press comprises a wedge-shaped pressing component for placing in the intermediate space with which the first and second inner template parts can be urged against the profile.

4. The device as claimed in claim 1, wherein the press comprises:

a yoke mounted on the outer template; wherein the drive unit is connected to the yoke.

5. The device as claimed in claim 1, wherein the pressing unit is a hydraulic or pneumatic pressure cylinder.

6. The device as claimed in claim 1, wherein the pressing unit is a manually operated pressure cylinder.

7. The device as claimed in claim 1, wherein each of the first and second inner template parts is provided with a chamfered positioning edge.

8. The device as claimed in claim 1, further comprising a plate-like filling component with a thickness substantially equal to a clearance between the inner template and the profile before the inner template is urged against the profile.

9. The device as claimed in claim 1, wherein the width of the outer template is given an adjustable form.

10. A method for repairing an upright profile bent out of an original position, wherein an inner space accessible from an open side is defined in the profile, the method comprising:

arranging an outer template around the profile such that the outer template encloses at least a portion of the profile, the outer template having a shape at least substantially complementary to an original form of the outer surface of the profile;

arranging an inner template in the inner space of the profile via the open side, the inner template having a shape at least substantially complementary to an original form of the inner surface of the profile, wherein arranging of the inner template in the inner space of the profile comprises:

arranging a first inner template part of the inner template in a portion of the inner space of the profile; and arranging a second inner template part of the inner template in another portion of the inner space of the profile;

urging the outer template against the outer side of the profile and urging the inner template against the inner side of the profile with pressing force from a press such that the profile is bent back to its original position, wherein the press comprises:

a drive unit and a pressing element, wherein the pressing element is coupled to the inner template such that the drive unit urges the pressing element against the inner template, the inner template being urged by the pressing element against the inner side of the profile with pressing force, and wherein the force of the pressing element against the inner template urges the drive unit away from the inner template, wherein the movement of the drive unit away from the inner template pulls the outer template against the outer surface of the profile such that the outer surface is bent back into its original form by the outer template, wherein urging inner template against the profile comprises:

mutually displacing the first and second inner template parts away from each other such that the first and second inner template parts are pressed against respective portions of the inner side of the profile.

11. The method as claimed in claim 10, wherein mutually displacing the first and second inner template parts with respect to one another comprises urging each of the first and second inner template parts in respective lateral and forward directions against the profile.

12. The method as claimed in claim 10, further comprising:

placing a wedge-shaped pressing component in an intermediate space between the first and second inner template parts;

urging the wedge-shaped pressing component further into the intermediate space in order to generate lateral and forward pressure whereby the first and second inner template parts are mutually displaced away from each other.

13. The method as claimed in claim 12, further comprising:

placing a yoke round the outer template;

coupling the drive unit to the yoke;

exerting a pressing force on the wedge-shaped component with the drive unit in order to urge the outer template and the inner template against the profile.

14. The method as claimed in claim 10, further comprising, after bending back of the profile, arranging a plate-like filling part in the intermediate space between the inner template and the profile, and repeating the step of urging the outer template against the outer side of the profile and urging the inner template against the inner side of the profile in order to bend the profile back further.

15. The method as claimed in claim 10, further comprising bending back one or more uprights of a warehouse rack.

* * * * *